United States Patent [19]

Walz

[11] Patent Number: 4,682,793

[45] Date of Patent: Jul. 28, 1987

[54] MULTI-PART MAILER FORM ASSEMBLY

[76] Inventor: Gerard F. Walz, 928 Quail Hill Rd., Fallbrook, Calif. 92028

[21] Appl. No.: 836,249

[22] Filed: Mar. 5, 1986

[51] Int. Cl.[4] ..... B41L 1/20; B65D 27/00; B65D 27/10

[52] U.S. Cl. ..... 282/11.5 A; 229/69; 229/70

[58] Field of Search ..... 282/11.5 A, 11.5 R, 282/25; 229/69, 70, 71, 72, 73, 17

[56] References Cited

U.S. PATENT DOCUMENTS

| | | | |
|---|---|---|---|
| 444,979 | 1/1891 | Harrison et al. | 229/70 |
| 3,304,103 | 2/1967 | Bensler et al. | 282/11.5 A |
| 3,419,286 | 12/1968 | Noonan et al. | 282/11.5 A |
| 3,507,519 | 4/1970 | McNabb | 282/11.5 R |
| 3,726,471 | 4/1973 | Kalb | 229/70 |
| 3,987,960 | 10/1976 | Gardiner | 229/74 |
| 3,993,299 | 11/1976 | O'Brien et al. | 229/69 |
| 4,211,434 | 7/1980 | Reese | 282/11.5 A |
| 4,213,639 | 7/1980 | Absler et al. | 282/11.5 A |
| 4,230,262 | 10/1980 | Denay et al. | 282/11.5 A |
| 4,236,731 | 12/1980 | Hektoen | 282/11.5 A |
| 4,346,916 | 8/1982 | Shelton | 282/11.5 A |
| 4,418,865 | 12/1983 | Bowen | 229/69 |
| 4,429,827 | 2/1984 | Murray | 229/70 |
| 4,493,496 | 1/1985 | Kaluza | 282/11.5 A |

FOREIGN PATENT DOCUMENTS

| | | | |
|---|---|---|---|
| 2252792 | 6/1975 | France | 282/11.5 A |

OTHER PUBLICATIONS

IBM Technical Disclosure Bulletin, vol. 5, No. 4 of Eichorn, Sep. 1982, Title "No Burst or Cut, Continuous Forms".

*Primary Examiner*—Paul A. Bell
*Assistant Examiner*—Paul M. Hoyrana
*Attorney, Agent, or Firm*—Brown, Martin, Haller & Meador

[57] ABSTRACT

A multi-part mailer form assembly comprises a series of superimposed continuous sheets each having spaced transverse tear lines for separating the sheets into individual multi-part forms. Opposite marginal edges of the assembly have superimposed pin feed perforations and the sheets are adhesively secured together along one marginal side edge and are separable from each other by means of tear lines. The front sheet is of paper and the rear sheet is of card and the intermediate sheets include at least one paper sheet with copy producing layers or means provided for reproducing information imprinted on the front sheet on the paper and card sheets. The sheets each have a designated address area in registry with corresponding designated address areas on all the other sheets. The rear sheet has tear lines for separating a predetermined sized area of the rear sheet carrying an address area on both faces from the rest of that sheet, and has adhesive strips on its outer face adjacent and outside the predetermined detachable area for securing it to an envelope.

19 Claims, 7 Drawing Figures

FIG. 3
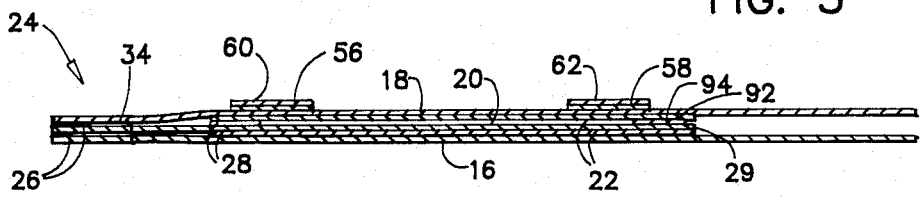
FIG. 4
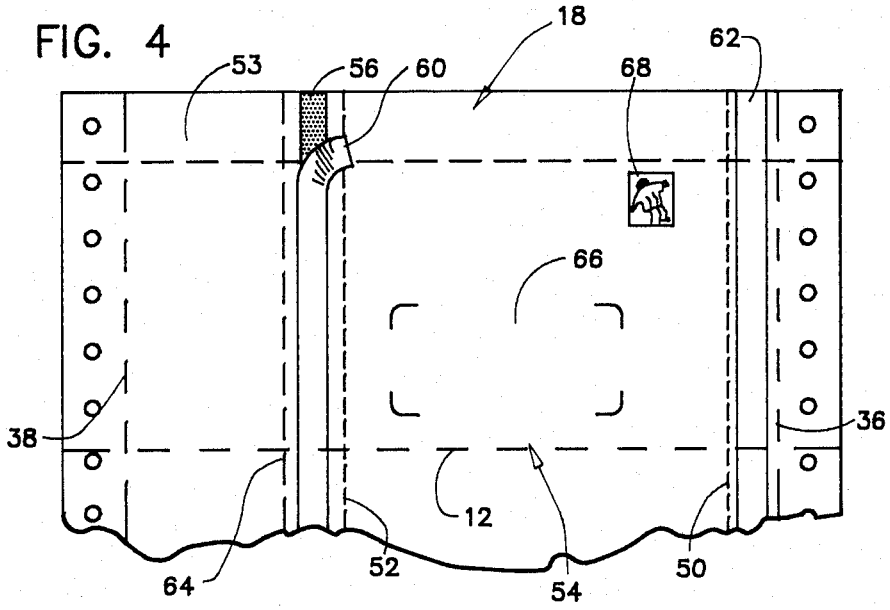
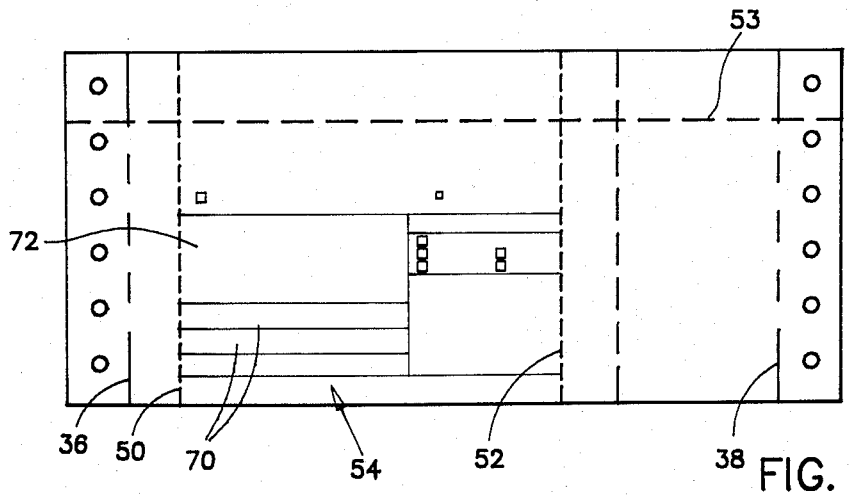
FIG. 5

MULTI-PART MAILER FORM ASSEMBLY

BACKGROUND OF THE INVENTION

The invention relates generally to continuous multi-layer forms of the type having pin feed perforations or sprocket holes along opposite marginal side edges for feeding the forms through printers or other data processing machines, the layers comprising plies of paper or card with interleaved copy producing sheets or copy producing coatings for reproducing information imprinted on one of the plies onto some or all of the other plies. The invention is specifically directed to multi-layer forms of the type particularly designed for mailing purposes.

Each layer of such continuous form assemblies will have spaced transverse tear lines in registry with the transverse tear lines in all the other layers for separating the assembly into individual form lengths, and tear lines at opposite side edges generally for separating each sheet from the perforated part of the marginal side edge.

Such an arrangement makes it unnecessary to feed individual form lengths manually into a printer, and allows information to be quickly and easily printed on a successive series of multi-layer forms. Continuous form assemblies of this type are used commonly in various business applications, such as accounting. One such arrangement is described, for example, in U.S. Pat. No. 3,987,960 of Gardiner where a continuous assembly of shipping forms for parcel items is provided. Each form includes a label to be adhered to the parcel item, which comprises two superposed areas joined at three edges to form an envelope, and one or more additional detachable sheets which may include a shipper's receipt, an accounting copy, delivery receipt and the like.

Another continuous mailer assembly is shown in U.S. Pat. No. 4,418,865 of Bowen, in which the multiple plies include an outgoing envelope, a message ply, and a return envelope.

One mailing procedure which up to now has involved the copying of information onto various separate individual forms for the mailing of one item is that of certified or insured mail. A certified mail item, for example, normally has a Post Office return card form as well as a certified mail slip secured to it, and the sender must also complete a receipt for the item to be retained by him. In some businesses many items of mail, such as reminders and the like, are sent by the certified mailing procedure, involving much repetition of typing or hand writing of addresses on the various forms which is tedious and time consuming. Thus although the use of memory typewriters and computers for word processing in offices is widespread, the process of preparing certified mail or other special mailing procedures is still done either manually or on a standard typewriter.

The certified mail procedure currently involves first the preparation of a hand or typewritten envelope addressed to the addressee. The standard Post Office receipt for certified mail is then typed or handwritten with the same address and other particulars. The gummed label which forms a detachable part of the standard receipt form and carries the article number for certified mail is then torn off, moistened and adhered to the left portion of the address side of the article. The label often comes loose and is therefore often secured with a strip of Cellotape (Registered Trademark) or the like. The receipt is retained by the sender for their records and, optionally, a postal clerk stamp of proof of delivery to the postal service may be obtained. The standard Post Office return receipt of delivery of certified mail is then completed with the required details, for example, the address and return address are typed or handwritten on opposite faces of the form, and any other details concerning the mailing are completed. The form is then secured to the article for completion at the point of delivery and return to the sender to confirm receipt of the article by the addressee.

It can be seen that this process is both tedious and time consuming, particularly for businesses where items of mail are commonly sent by certified mail. In some instances the procedure requires the completion of a further envelope for sending of a copy of the item by normal mail, adding further work to the procedure.

SUMMARY OF THE INVENTION

According to the present invention a continuous mailer assembly is provided which comprises a plurality of superimposed sheets having corresponding spaced transverse tear lines in registry with one another for separating the assembly into individual multi-part forms. At least some of the sheets have opposite marginal side edges with superimposed pin feed perforations for feeding the assembly through a printer or the like, and the sheets are adhesively secured together along at least one marginal side edge. The sheets are separable from one another and from the marginal side edges by means of suitable longitudinal tear lines.

The sheets making up each form comprise a front sheet of paper having tear lines for tearing it down to fit into a chosen size standard window envelope, a rear sheet of card having a predetermined detachable return card area separable from the remainder of the sheet by means of additional tear lines, and an intermediate sheet which has tear lines for tearing it down to a predetermined detachable receipt area. Copy producing means are interposed between the sheets for transferring information printed on the front sheet onto the other sheets. The copy producing means may comprise copy or image producing coatings applied to opposed faces of successive sheets of the assembly, or interleaved copy producing layers, for example of carbon paper or the like, may be provided between the sheets.

Each of the sheets has a designated address area on its front face in registry with the address areas on the other sheets, and the address area on the front sheet is positioned to register with the window of a chosen standard window envelope. The address areas on the intermediate and rear sheets lie in the predetermined detachable areas which can be torn out and separated from the remainder of those sheeets. The rear sheet additionally has a designated return address area on its rear, outer face which also lies in the predetermined detachable return card area of the sheet. Adhesive strips are provided on the outer face of the rear sheet adjacent and outside the detachable area for securing the detachable area to an envelope.

Preferably, the predetermined detachable return card area of the rear sheet is in the form of a certified mail return receipt postcard-type form with areas designated for the required information on such forms such as date of delivery and signature of the receiving party. The intermediate layer will then be in the form of a certified mail receipt for retention by the sender of the item, and preferably includes a further detachable strip or label removable from the remainder of the sheet by additional tear lines and carrying a mail receipt or certified mail item number which is also provided on the sender's receipt, the front sheet and the postcard area of the rear sheet. The detachable strip has an adhesive area on its rear face which is covered by a removable cover layer and which is used to secure the strip to the envelope or other item to be mailed.

Thus with this mailing assembly the certified mailing procedure can be carried out much more quickly and easily than the previous manual procedure. The continuous form assembly can be fed through any standard office printer or memory typewriter, and successive forms can be printed with a series of addresses to which certified mail items are to be sent. The successive forms are typically sequentially numbered with the same number appearing or the detachable area of each sheet of each form. The address on each form will be impressed on all the sheets of that form. The front sheet can then be separated from its marginal edges and inserted in the window envelope along with the item to be mailed, the rear sheet can be separated and secured via its adhesive strips to the envelope, and the inner sheet receipt area can be separated for retention by the sender. The additional strip or label on the inner sheet is also separated and secured to the envelope via its adhesive strip. Thus the certified mailing process is simplified considerably over the previous procedures. This type of form assembly can also be used to simplify and automate other standard mailing procedures involving sender and return receipts, for example insured mail procedures.

BRIEF DESCRIPTION OF THE DRAWINGS

The present invention will be better understood from the following detailed description of a preferred embodiment, taken in conjunction with the accompanying drawings in which like reference numerals refer to like parts and in which:

FIG. 3 is an exploded cross-section through the assembly on the lines 3—3 of FIG. 1;

FIG. 4 is a rear elevational view of the back sheet of the assembly;

FIG. 5 is a front elevational view of the inner face of the back sheet;

DESCRIPTION OF THE PREFERRED EMBODIMENT

Figure 1:
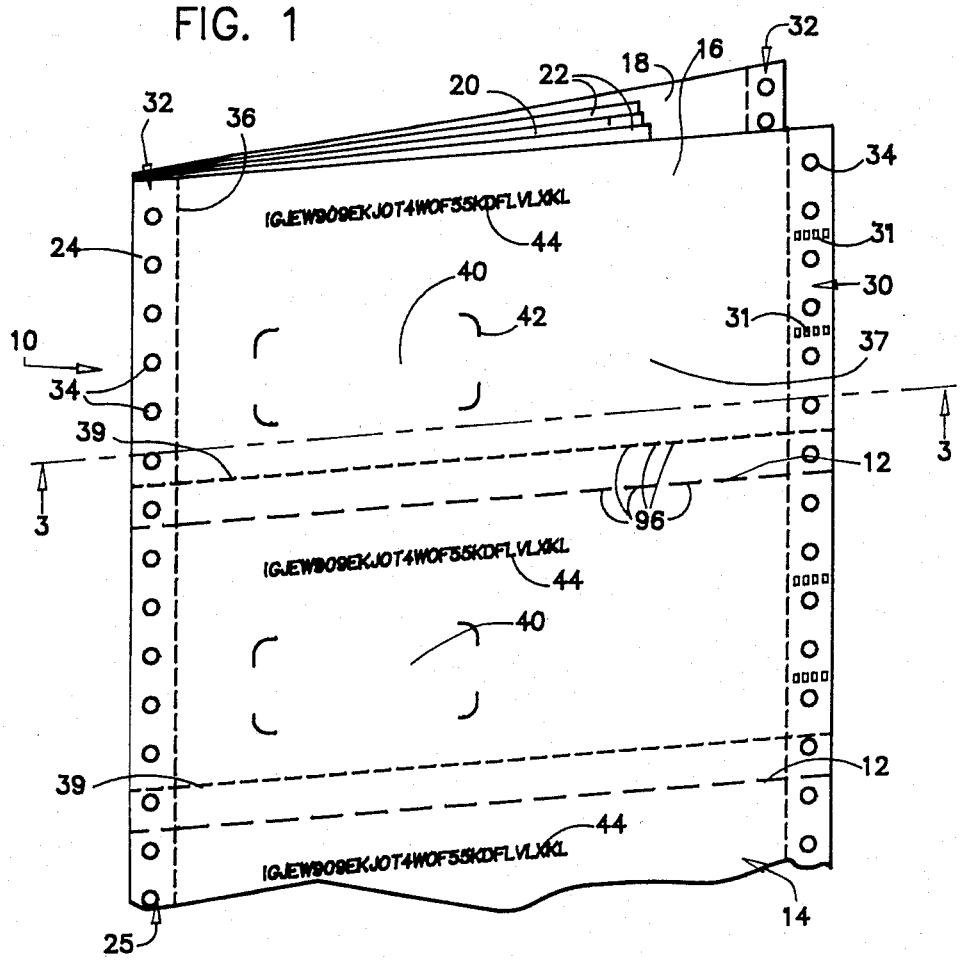
FIG. 1 is a perspective view of a length of the mailer assembly according to a preferred embodiment of the present invention.

A preferred embodiment of a continuous multi-part form assembly according to the invention is shown in the drawings. As indicated in FIG. 1, the assembly 10 comprises several superimposed layers of continuous sheet material which have corresponding spaced transverse tear lines 12 in registry with the transverse tear lines in the other sheets for separating the assembly into individual, multi part forms 14, two of which are shown in FIG. 1. Thus the assembly will be produced in continuous lengths containing a plurality of separable, multi-part forms.

The layers of the assembly comprise a first, front sheet 16 of paper, a second, rear sheet 18 of card material, and a third, intermediate sheet 20 of paper between the first and second sheets. Copy-producing layers 22, suitably of carbon coated paper or the like, are interposed or interleaved between the sheets 16, 18 and 20 for reproducing information imprinted on the front sheet onto all the other sheets. As an alternative to the separate layers 22 of carbon paper or the like, the information printed on the front sheet may be printed on corresponding areas of the other sheets for example, by coating or treating opposing faces of the respective sheets with suitable copy-producing chemicals to produce so-called "carbonless" copy paper of which NCR paper is typical. Thus the rear faces of sheet 16 and sheet 20 may be carbonized or treated with chemicals in appropriate areas or over the entire face to reproduce information imprinted on the top sheet on all of the other sheets. Alternatively, the sheets 16 and 20 may comprise carbonless copy paper such as NCR paper with a carbon paper layer interleaved between sheet 20 and rear sheet 18.

Figure 2:
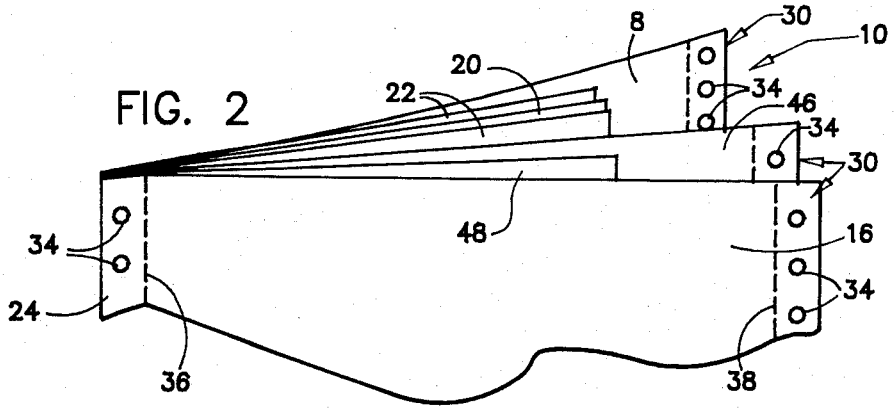
FIG. 2 is a partial perspective view similar to FIG. 1 showing a modified embodiment of the invention.

Although FIG. 1 shows a three part form, additional sheets may be interleaved between the front and rear sheets if a form having a greater number of separable sheets is required. A modified embodiment having four parts is illustrated in FIG. 2 by way of example. This embodiment is discussed in more detail below. Clearly forms having additional parts can be devised in a similar manner.

As can be seen in FIGS. 1 and 3, the three sheets are adhesively secured together along their aligned left-hand marginal edges 24 by means of adhesive 26 or any other suitable attachment means. The carbon paper layers, if used, are suitably adhesively secured to the respective overlying sheet at their left hand edge 28, as can be seen in FIG. 3, with the left hand edges of the carbon paper layers offset inwardly from the left hand marginal edges of the sheets.

The intermediate sheet 20 in the preferred embodiment is narrower than the front and rear sheets so that its right hand edge 29 is offset inwardly from the right hand edges of the front and rear sheets. The front and rear sheets are shown not positively secured together at their right hand marginal edges 30, but these sheets are temporarily held together during processing and printing by means of spaced rows of punch holes 31 extending through the right hand marginal edges of both sheets. In alternative embodiments for providing different types of forms the sheets may be adhesively secured together at both opposite edges or at the right hand edges only, with the intermediate sheet in the latter alternative positioned with its right hand edge in registry with the right hand edges of the first and second sheets so that its left hand edge is offset inwardly from the left hand edges of the other sheets.

It will be understood that the transverse tear lines 12 are provided in registry with one another in all of the sheets and intervening carbon layers so that the assembly can be easily separated into individual forms.

The left and right hand marginal edges of the front and rear sheets and the left hand marginal edge of the intermediate sheet 20 are provided with lines 32 of pin feed perforations or sprocket holes 34 which extend through all the layers in the respective marginal edges 24 and 30. These perforations are arranged to allow the form assembly to be fed continuously through the standard tractor feed of various data processing machines such as printers with the perforations engaged on the feed pins or drive spindles of such machines.

Longitudinal tear lines 36 and 38 are provided adjacent the left hand marginal edges of all three sheets and the right hand marginal edges of the front and rear sheets, respectively, for separating the sheets from each other and from the marginal edge portions carrying the lines of perforations. As seen in FIG. 3, the tear line 36 is spaced inwardly from the adhesive strips 26. The left hand tear lines are preferably superimposed through all the underlying sheets and positioned just outside the left hand edges of the carbon paper layers, as can be seen in FIG. 2. The carbon paper layers are of the same width as the intermediate sheet 18. The right hand tear lines 38 in the front and rear sheets may be in registry with one another, but this is not essential and the lines 38 may be offset with the line 38 in the front sheet located further from the adjacent marginal edge than the corresponding line 38 in the rear sheet. The positioning of the lines 36 and 38 is chosen according to the desired width of the separated form part, as discussed in more detail below.

The format of one multi-part form in the assembly will now be described in more detail. It will be understood that all the forms will be of an identical format, apart from their sequential numbering as described in more detail below. The form described is designed specifically for carrying out a certified mailing procedure, but alternative forms may be designed for alternative mailing procedures in a similar manner.

In the preferred embodiment of the invention, the front part or sheet of the individual form is designed to fit a chosen standard window envelope, the intermediate part or sheet is a sender's receipt for a certified mailing procedure and incorporates the adhesive label carrying the certified mail item number, and the rear part is the return receipt card for the certified mailing procedure. The address areas on the front faces of each of the sheets are designed to coincide or register, as discussed in more detail below. Since the address area on the front sheet is limited by the window position of a standard window envelope, and the address areas on the intermediate and rear sheets are limited by the position of that area on the standard Post Office forms, the assembly must be dimensioned and designed to allow registration of these predetermined address areas. Clearly the dimensions and arrangement may be different for different format forms.

The width and length of the detachable area of front part or sheet of an individual form 14 defined by the tear lines is designed to correspond to that of a chosen standard window envelope (i.e. an envelope having a transparent "window" opening through which an address normally appears) by suitable positioning of the left and right vertical tear lines 36 and 38 and an additional transverse tear line 39. Thus the torn down or detachable area between tear lines 12, 39, 36 and 38 is chosen to equal that of a standard window envelope.

In the preferred embodiment the torn down area 37 of sheet 16 is designed for fitting a No. 10 window envelope, with the torn down dimensions within detachable area 37 being 4 inches by 9 inches. The form length prior to tearing off along tear line 39 is 5 inches, so that tearing along line 39 detaches a one inch strip along the bottom of each form front sheet. Preferably, the transverse tear lines 12 separating successive forms 14 are weaker than the additional transverse tear line 39, as indicated by the longer slit length of these tear lines in FIG. 1. This allows successive forms to be separated easily before the lower strip of each form between tear lines 39 and 12 is separated.

The sheet 16 is provided on its front face within tear down or detachable area 37 with a designated address area 40 by suitable blocking 42, for example, printed on its front face. The sheet is also printed with a reference number or code 44. Each form in the assembly is provided with its own specific reference number or code for identifying all the separate parts of that form, and any desired number of digits may be provided in the code. In the preferred embodiment for certified mail the code is in the form of a 9 digit OCR font number preceeded by a P, as required by the Post Office. However other codes may be used for alternative mailing procedures. In the normal arrangement the individual forms will be sequentially numbered throughout the assembly.

The address area 40 is positioned to register with the window opening of a chosen standard window envelope when the front sheet of a form is separated along its tear lines and placed in the envelope. The area 40 may be printed with an addressee's name and address in addition to an optional reference number for use by the sender. The window area length is normally 7 lines of 1/6 inch each and its width is 32 characters at 10 characters per inch. However other window areas may be used in other embodiments as long as they appear within a standard window envelope.

In a modified embodiment of the invention as illustrated in FIG. 2 the assembly may be provided with an additional sheet 46 identical to and underlying sheet 16 with an intervening carbon layer 48 or copy producing coatings on the opposed faces of the sheets so that two identical mailing items such as letters may be sent to the same address, one by regular mail and the other by certified mail so that at least one will be delivered even if the occupant is not home. The construction of sheet 46 with tear lines, marginal edges and perforations is the same as that of sheet 16. The printing on the sheet 46 may be identical to that of sheet 16 with the same reference number 44 and designated address area 40, but it may include some additional wording such as "REGULAR MAIL" for example.

The rear, card material sheet 18 will now be described in more detail with reference to FIGS. 3, 4 and 5. As shown in FIG. 4, the rear sheet 18 is provided with additional tear lines in addition to the transverse lines 12 separating the sheet into individual form sheets, and the right and left longitudinal tear lines 36 and 38 separating the sheet from the marginal edge portions. The additional tear lines include spaced longitudinal tear lines 50 and 52 and additional transverse tear line 53 for separating a predetermined return card area 54 of the sheet 18 from the remainder of the sheet. Located just outside the additional tear lines 50 and 52 on the outer face of the rear sheet, and extending alongside them along the length of sheet 12 are spaced self-adhesive strips 56 and 58 covered by protective cover strips 60, 62 respectively. The adhesive strips are a suitable contact adhesive and the cover strips 60 and 62, suitably of lightweight paper, can be pulled or peeled off as indicated at the top of FIG. 4 to uncover the adhesive.

An additional longitudinal tear line 64 is provided along the rear sheet to extend outside and alongside the innermost adhesive strip 56, so that the part of the rear sheet of each form carrying the postcard sized area 54 and the adhesive strips inside tearlines 36 and 64 can be separated from the remainder of that sheet.

The dimensions of the detachable area 54 of the rear sheet correspond to those of a standard return receipt card as is used in certified mailing procedures in the preferred embodiment of the invention, as described in more detail below. The area 54 is normally equal to a standard postcard size.

The rear face of the detachable area of the rear sheet of each form is suitably imprinted with a return address area 66 and a postage stamp area 68. The inner face of the detachable area is shown in FIG. 5 and is provided with various blocks 70 for insertion of appropriate information as is normally required in a certified mailing procedure, for example. Clearly alternative blocks and information could be imprinted on this area in alternative embodiments of the invention to carry out other mailing procedures. One of the blocks 72 is designated as the address area and this area is positioned in registration with the address area 40 of the front sheet 16 so that an address printed on the front sheet will also be reproduced via the overlying carbon paper layer or other copy producing medium onto the rear sheet 18.

Another of the blocks 74 contains the reference number 44 which corresponds to the number imprinted on the front sheet 16 of that form. The remaining blocks are for insertion of other information as is required on a certified mail return receipt, for example, such as the signature of the addressee, postmark, date of delivery and so on. In the preferred embodiment of the invention the rear part of each individual form is printed to correspond to the current format of PS Form 3811 (Return Receipt, Certified Mail)of the U.S. Post Office. The current dimensions of this form are 4 inches by 5 14/32 inches, and the tear lines 50 and 52 are therefore separated by 5 14/32 inches, with the transverse tear lines 53 and 12 separated by 4 inches. Clearly these dimensions may be adjusted by altering the positions of the tear lines if a different return card form size is desired. However, the dimensions should be within the Post Office requirements for postcard sized. The individual form length of sheet 18 between succcessive tear lines 12 is 5 inches, to correspond to the length of front sheet 16. The increase in length of 1 inch of the front and rear sheets with the front sheet of each form having a lower tear off strip of 1 inch below line 39 and the rear sheet having an upper tear off strip of 1 inch above line 53 is necessary in the illustrated embodiment to allow address area 40 to register with address area 72 on the rear sheet and still be positioned correctly for a standard window envelope. The material of rear sheet 20 is suitably 110 lb green index card stock as is used for the Post Office form referred to above.

The front sheet 16 in the preferred embodiment is therefore designed so that the designated address area will coincide with the address area of a chosen standard Post Office form. The format of the front sheet of the assembly can clearly be modified if necessary as a result of possible future revisions of the certified mail forms. The front and rear sheets of the form are designed so that the address areas can register while still allowing the address area 40 to be positioned correctly for a window envelope. In an alternative embodiment where the address area 72 on the rear sheet is positioned lower down on the card, for example, the additional transverse tear lines may be omitted with the overall form lenth being 4 inches.

Figure 6:
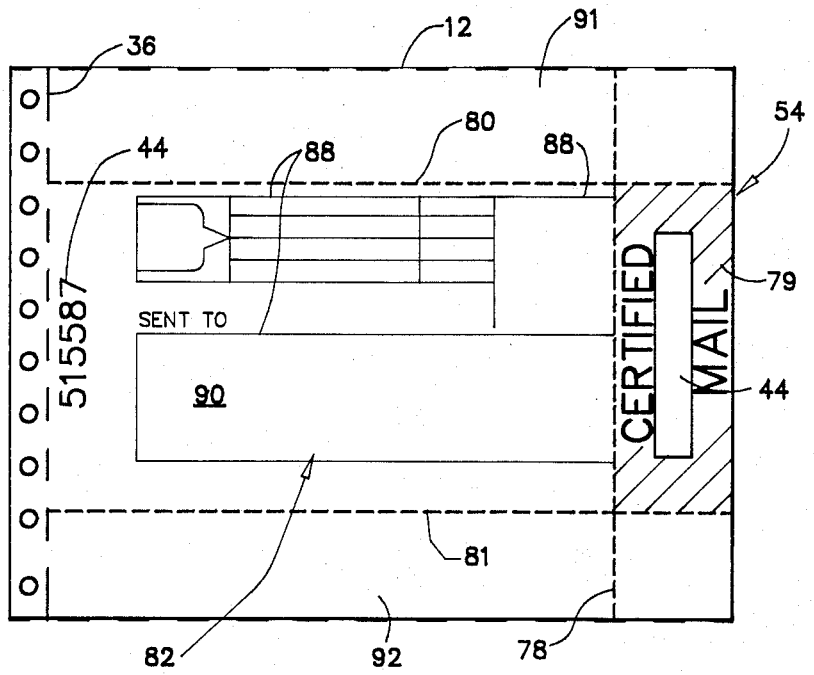
FIG. 6 is a view of the front face of the inner sheet.
Figure 7:
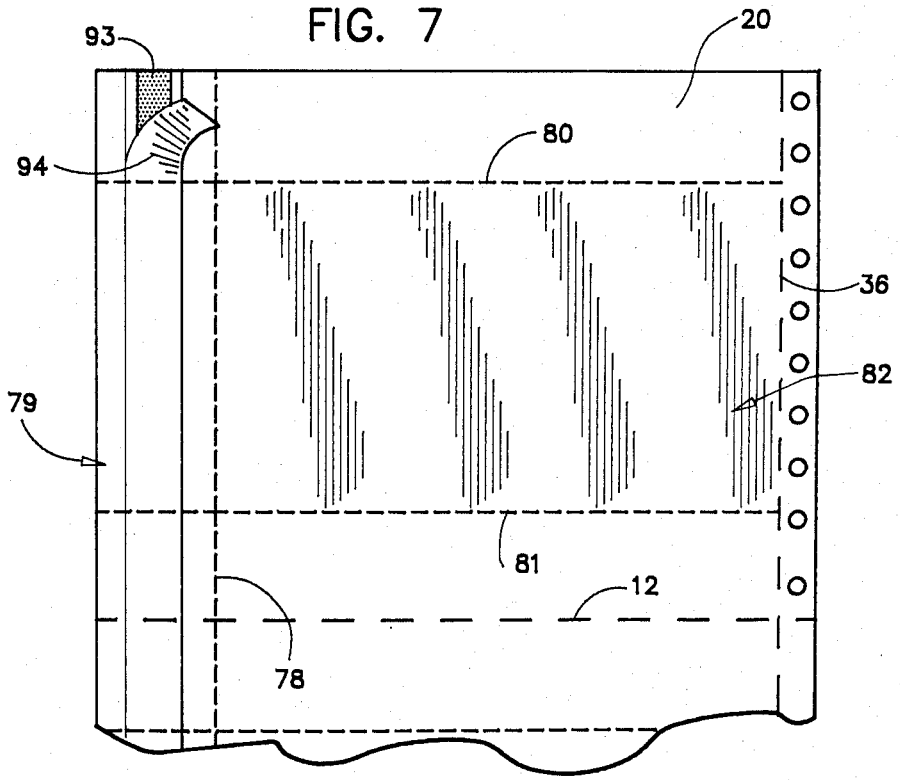
FIG. 7 is a view of the rear face of the inner sheet.

The opposite faces of the intermediate sheet 20 are shown in FIGS. 6 and 7, FIG. 6 showing the front face which faces towards front sheet 16 of the assembly. In addition to the transverse tear lines 12 for separating sheet 20 into individual form lengths, and longitudinal tear line 36 adjacent the left hand marginal edge for separating this sheet from the remaining sheets, the sheet 20 also has an additional longitudinal tear line 78 spaced inwardly from its right hand edge to define a narrow strip or label 79, and additional spaced transverse tear lines 80 and 81 for removing strips from the upper and lower parts of the sheet.

The detachable area of sheet 20 defined between tear lines 36, 78 and 80, 81 comprises a receipt area 82 printed with information for retention by the sender of a mailed article. Tearing along lines 78, 80 and 81 will separate sheet 20 into receipt area 82 and a numbered code strip or label 79. Both the receipt area 82 and the code strip 79 are printed with the reference or certified item number 44 corresponding to the particular number imprinted on the other layers of that particular form. The strip 79 is of the type normally affixed to certified mail items to indicate the certified mailing number.

The receipt area is imprinted with information blocks 88 in a similar manner to rear sheet area 54. One of the blocks 90 comprises a designated address area which registers with the designated address areas on all the other sheets of the form so that the same address can be simultaneously impressed on all the sheets. The remaining blocks are for receiving other information concerning the mailing, such as the postage and fees paid, and the postmark or date of mailing. This may suitably correspond to PS Form 3800 (Receipt for Certified Mail) of the United States Postal Service. This form has dimensions of 3 inches by 6 11/32, (including tear off strip 79) so the sheet 20 has upper and lower tear off strips 91 and 92 which are each one inch in length to allow this form to have its address area 90 registered with the designated address areas of the other two sheets. The overall dimensions of an individual form length of sheet 20 prior to tearing down along its additional tear lines are 5 inches by 6 11/32 inches.

As shown in FIG. 7, the rear face of sheet 20 is provided with a continuous strip 93 of contact self-adhesive which extends on the underside of code strip 79. Adhesive strip 93 is covered by a continuous cover strip 94 of paper or the like which can be peeled off as indicated in FIG. 7 to uncover the adhesive. Preferably, each of the cover strips 60, 62 and 94 are wider than the underlying adhesive strips 56, 58 and 92, respectively, so that an edge of the cover strip can be easily lifted when the user wishes to peel off the cover strip to uncover the underlying adhesive.

To prepare a series of forms for mailing, the assembly 10 is first fed through a printer or the like and a series of addresses are printed on the successive forms 14. The individual forms are then separated along transverse tear lines 12 and the sheets of each form are separated from each other and the marginal edges along longitudinal tear lines 36 and 38. The interleaved carbon layers, if used, are pulled out and discarded. The front sheet 16 of each form is then placed in an envelope along with the item to be mailed, arranged so that the address appears in the window area of the envelope. The envelope is sealed. The rear sheet of each form is then separated along longitudinal tear line 64 and transverse tear line 39, to leave the detachable return card area 54 and adhesive strips 56 and 58. The cover strips are peeled off and the postcard sized area is affixed to the envelope with the front face shown in FIG. 5 facing outwardly. The sender's address will first be printed or affixed in the return address area 66 of each rear sheet. This may be done prior to printing of the cover sheets of each form, or standard sticky labels with the sender's address may be secured to each form as is done commonly by businesses. For a specific business, a form assembly rear sheet may be pre-printed with the appropriate address in area 66 of each form.

The intermediate sheet of each form is then separated along its tear lines 78, 80 and 81, either before or after the item and receipt 82 are postmarked, and the separated code strip or label 79 is affixed to the envelope by pulling off cover strip 94 to reveal adhesive strip 92, and sticking the strip 79 onto the envelope. After completion of the necessary information regarding mailing date and the like, the receipt 82 is retained by the sender and the item is mailed. Where the form has four parts as indicated in FIG. 2, an item to be mailed such as a certified letter will be placed in a first envelope along with torn down address area of cover sheet 16, with the certified mail return receipt sheet affixed to the envelope as described above, and a copy of the item will be placed in a second envelope with the similarly torn down address area of extra address sheet 46 for sending by normal mail.

When the mailman delivers the certified item, the return receipt will be completed in the standard fashion, separated along lines 50 and 52 to remove the postcard sized area 54 from the envelope, and can then be returned to the sender to confirm receipt of the item by the addressee.

This continuous mailer assembly and certified mailing procedure is substantially simpler and less time consuming than that used commonly in businesses up to now, where several separate forms and receipts had to be completed separately for each item to be mailed. With this mailer assembly a large number of items to be mailed can be prepared quickly and efficiently, and this is particularly useful for businesses that use certified or other multi-form mailing procedures as a matter of standard practice. The assembly may be used in conjunction with a data base of stored names and addresses on a computer or memory typewriter set up to print the names and addresses automatically on successive form lengths of the assembly.

In the preferred embodiment illustrated each of the tear lines comprise slits 96. The slits forming the transverse lines of weakening 12 for separating the assembly into individual forms extend through all the sheets and carbon paper layers of the assembly, and the slits forming longitudinal lines of weakening or tear lines for separating the sheets at their left hand edges extend through all three sheets 16, 18 and 20, as well as the interleaved carbon layers, with the slits of tear line 38 extending along sheet 16 and 20 (and sheet 46 in the four part embodiment of FIG. 2). The additional tear lines in the intermediate and rear sheets will be formed in those sheets prior to assembly of the superimposed sheets.

The force required to separate the sheets along the tear lines will depend on the length of the slits forming the tear lines, with the longer slits producing weaker tear lines. Thus in the rear sheet the tear lines are graduated inwardly from the outer edges of the sheet, with the outermost tear lines 36 and 38 having the longest slits, the next intermediate additional tear line 64 having the next longest slits, and the innermost tear lines which will be the last to be separated being the shortest and thus the strongest, to avoid accidental separation of the return card during mail processing. Thus if a person pulls the outer edges of the rear sheet it will first separate on lines 36 and 38. A further pull will separate it on line 64, leaving lines 50 and 52 intact for mailing the form secured to an envelope. Similarly, the additional transverse tear lines on each part of the form are stronger than tear lines 12 for separating the assembly into individual form lengths, so that tear lines 12 will always be the first to separate. Thus tear lines 12 have longer slits than tear lines 39, 53, 80 and 81, as can be seen in the drawings.

The assembly is preferably formed from continuous lengths of preprinted paper and card to provide sheets 16, 18 and 20, sheet 20 preferably being narrower in width than the sheets 16 and 20. The sheets will be printed in selected areas with a continuous series of forms containing the desired blocking and form information as discussed above. Successive forms of each sheet will be printed with sequential code numbers in the designated areas. Continuous spaced adhesive strips 56 and 58 are applied to card sheet 20 by a suitable applicator, and cover strips 60 and 62 are placed over the adhesive. Similarly, the continuous adhesive strip 92 and cover strip 94 are applied to intermediate sheet 20.

The tear lines in each sheet are then formed in a standard perforating machine, set up to provide the desired stronger and weaker tear line arrangement discussed above. The transverse tear lines 39, 51, 80 and 81 in the respective sheets do not extend to the left hand marginal edge of the sheet, but only far enough to reach the longitudinal tear line 36 by which the sheet is separated from its marginal edge.

Interleaved layers or sheets of carbon paper or other copy producing material, if used, are then adhesively secured to the appropriate sheets along their left hand marginal edges. Alternatively, sheets 16 and 20 are of carbonless copy paper such as NCR paper.

The sheets are then superimposed with their left and right hand edges in registry, and suitably adhesively secured together along their left hand edges. At this point the assembly is fed through suitable machinery for forming the lines of pin feed perforations. The longitudinal and transverse tear lines 12 and 36 which extend through all the superimposed sheets in their position may be formed either before or after the sheets are secured together. This continuous multi-part form assembly can easily be produced by the above method in a production line process.

Although a preferred embodiment of the invention has been described above by way of example, it will be understood by those skilled in the field that modifications may be made to the disclosed embodiment without departing from the scope of the invention, which is defined by the appended claims.

I claim:

1. A multi-part mailer assembly, comprising:

a series of superimposed continuous sheets having at least one aligned marginal side edge along which the sheets are adhesively secured together and copy producing means interposed between the sheets for reproducing information applied to the front sheet on all the underlying sheets, the outer front sheet of the assembly being of paper and the rear sheet being of card material;

the sheets having corresponding spaced transverse tear lines in registry with one another for separating the sheets into individual multi-part forms;

the assembly having lines of pin feed perforations extending along its opposite outer marginal side edges through all the sheets at those side edges for feeding the assembly through a printing machine;

the assembly having an outer longitudinal tear line extending adjacent the secured marginal side edge for separating the sheets from each other and from the line of pin feed perforations at that edge;

each multi-part form of the assembly having at least three seperable superimposed parts preprinted with predetermined indicia, the three parts including form lengths of a front sheet comprising an address sheet for insertion in a window envelope, a rear sheet comprising a return postcard for separation from the other sheets and for securing to the exterior of an item to be mailed for completion and return by the recipient of the mailed item, and an intermediate sheet comprising a sender's receipt for retention by the sender of a mailed item, the front sheet of each said form having a designated address area on its outer front face and the intermediate and rear sheets having front faces facing the rear of said front sheet which are marked with a corresponding address area in registry with the address area on the front sheet;

the rear and intermediate sheets of the assembly having additional tear lines for separating a predetermined detachable area of the rear and intermediate part of each form from the remainder of that part, the predetermined area of the intermediate and rear parts carrying the designated address area on their front faces and the rear part having an outer, rear face facing away from the remainder of the form carrying a designated return address area on its detachable area; and the rear sheet having longitudinal strips of adhesive applied along the rear, outer face outside said predetermined area for detachably securing the predetermined area of the rear part of each form to an outer face of an item to be mailed, the outer face of the rear sheet further having peeloff longitudinal cover strips removably covering the adhesive strips.

2. The assembly as claimed in claim 1, wherein the front part of each form includes a detachable area carrying the designated address area which is dimensioned to fit into a chosen standard window envelope having a generally rectangular, transparent window area on its front face with the designated address area in registry with the window area of the envelope.

3. The assembly as claimed in claim 1, wherein the intermediate sheet has a further longitudinal tear line extending adjacent its free marginal edge for separating a strip of each form length of the intermediate sheet from the remainder of the sheet, each strip comprising a coded label carrying a predetermined reference number for the respective form and the remaining parts of each form carrying the corresponding reference number, the intermediate sheet further having a longitudinal strip of adhesive applied to the opposite face of the separable strip to the reference number, and a peel-off cover strip removably attached to the adhesive strip.

4. The assembly as claimed in claim 1, wherein the intermediate and rear sheets each have marked areas in the detachable area of each form length for receiving predetermined information concerning a mailed item.

5. The assembly as claimed in claim 1, including a further sheet of paper underlying the front sheet and of the same format and width as the front sheet, and copy producing means between the front sheet and further sheet.

6. The assembly as claimed in claim 5, wherein the front sheet and further sheet have detacahable areas dimensioned for fitting into chosen standard window envelopes with the designated address area in registry with the window area of the respective envelope.

7. The assembly as claimed in claim 1, wherein the intermediate sheet is of narrower width than the other sheets of the assembly.

8. The assembly as claimed in claim 1, wherein each of the sheets include additional tear lines to tear down these sheets into predetermined detachable areas after separating them into form lengths.

9. The assembly as claimed in claim 8, wherein the tear lines comprise lines of slits, and the outermost transverse and longitudinal tear lines in each form length of each sheet have longer slits than any inner tear lines.

10. The assembly as claimed in claim 1, wherein the front sheet of each form length has spaced longitudinal and transverse tear lines for detaching an area of 4 inches by 9 inches.

11. The assembly as claimed in claim 1, wherein the additional tear lines of the rear sheet comprise a pair of longitudinal tear lines defining a detachable area of predetermined width and position and the adhesive strips extend alongside the additional longitudinal tear lines outside the detachable area.

12. The assembly as claimed in claim 11, wherein the rear sheet has an additional transverse tear line to separate a detachable area shorter than one form length.

13. The assembly as claimed in claim 11, wherein the rear sheet includes a further longitudinal tear line outside one of the adhesive strips to separate an area of each form length of the rear sheet including the detachable area and adhesive strips from the remainder of that sheet.

14. The assembly as claimed in claim 13, wherein the outermost longitudinal tear lines of the rear sheet are weaker than the inner two tear lines.

15. The assembly as claimed in claim 3, wherein the intermediate sheet has an additional two spaced transverse tear lines spaced between the transverse tear lines defining each form length to define a detachable area and coded tab of predetermined length and position relative to the detachable areas of the other sheets.

16. The assembly as claimed in claim 15, wherein the length of the detachable area of the intermediate sheet is 3 inches.

17. The assembly as claimed in claim 1, wherein successive forms in the assembly are marked with sequential numbers.

18. The assembly as claimed in claim 1, wherein each form length is of the order of 5 inches, and the front and rear sheets of the assembly have additional transverse tear lines for tearing down detachable area of those sheets to 4 inches in length.

19. The assembly as claimed in claim 18, wherein the additional transverse tear line in the front sheet is for separating the uppermost 4 inches of that sheet and the additional transverse tear line in the rear sheet is for separating the lowermost 4 inches of that sheet, with the designated address area in the detachable area of the front sheet coinciding both with the window area of a standard window envelope and the designated address area of the detachable area of the rear sheet.

* * * * *